US007819150B1

(12) United States Patent
Hoover

(10) Patent No.: US 7,819,150 B1
(45) Date of Patent: Oct. 26, 2010

(54) STAKE POINTER WITH IMPROVED CLEARING APPARATUS

(76) Inventor: Lloyd Hoover, 1466 E. Newport Rd., Lititz, PA (US) 17543

( * ) Notice: Subject to any disclaimer, the term of this patent is extended or adjusted under 35 U.S.C. 154(b) by 57 days.

(21) Appl. No.: 12/437,568

(22) Filed: May 8, 2009

Related U.S. Application Data

(60) Provisional application No. 61/052,763, filed on May 13, 2008.

(51) Int. Cl.
*B27M 3/28* (2006.01)

(52) U.S. Cl. ..... 144/360; 144/365; 144/12; 144/30

(58) Field of Classification Search ..... 144/12, 144/30, 141–143, 137, 168–171, 181.3, 242.1, 144/245.1, 245.2, 359, 360, 363, 365
See application file for complete search history.

(56) References Cited

U.S. PATENT DOCUMENTS

| | | | | |
|---|---|---|---|---|
| 3,111,971 | A | 11/1963 | Spencer | |
| 3,118,476 | A | 1/1964 | Fiore | |
| 3,277,932 | A | 10/1966 | Rouse | |
| 3,719,216 | A * | 3/1973 | Tracy | 83/471.2 |
| 4,387,751 | A | 6/1983 | Carter | |
| 5,109,896 | A | 5/1992 | Tomes et al. | |
| 5,638,877 | A | 6/1997 | April | |
| 6,135,174 | A | 10/2000 | Neville | |
| 7,712,495 | B1 * | 5/2010 | Hurst | 144/360 |

* cited by examiner

*Primary Examiner*—Shelley Self
(74) *Attorney, Agent, or Firm*—Andrew D. Mead

(57) ABSTRACT

An improved machine for pointing a wooden stake having a cutting tool that includes a movable plunger having motion coordinated with the feed and ejection motion of the stakes in the machine that assures that any debris entrapped in the cutting tool is dislodged and discharged from the cutting tool during the interval between the discharge of an already-pointed stake and the feeding of an un-pointed stake.

10 Claims, 4 Drawing Sheets

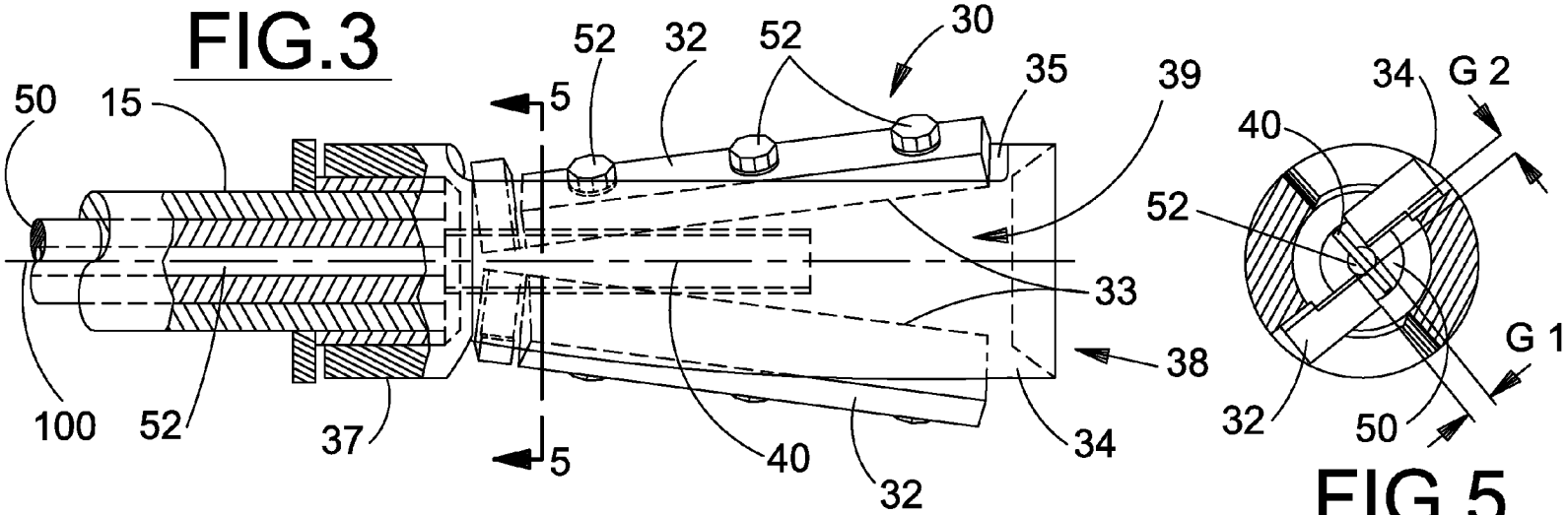
FIG.3
FIG.5
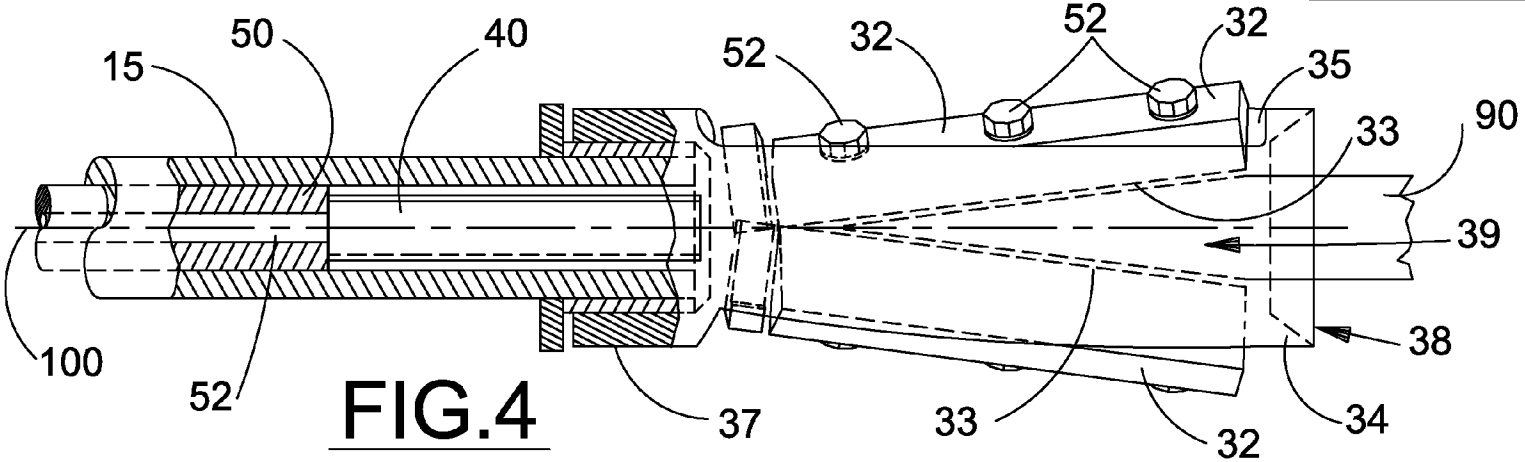
FIG.4

STAKE POINTER WITH IMPROVED CLEARING APPARATUS

CROSS-REFERENCE TO RELATED APPLICATIONS

This application claims the benefit of priority of U.S. Provisional Application 61/052,763, filed May 13, 2008.

BACKGROUND OF THE INVENTION

The present invention relates generally to machines for producing a tapered end on a wooden stake, and more particularly to an apparatus for clearing debris from a rotating cutting head while the head is rotating.

Milling a point on the end of a wooden stake may be performed by a task-specific milling machine equipped with an apparatus for feeding an end of a wooden stake axially into a cutting tool which produces a tapered portion on the end of the stake. The cutting tool typically comprises one or two cutting knives held in a fixed position in the tool and angled from the longitudinal centerline of the stake. As the cutting tool is rotated relative to the stake, the knives remove material from the stake to form a pointed end. Openings in the tool allow chips and dust created by the cutting process to move out of the tool where they may be gathered by a dust collection system. A machine of this type is capable of pointing 30-60 stakes per minute.

From time to time, a stake having a flaw will be fed into the machine which may result in the tip of the stake breaking off from the rest of the stake and remaining lodged within the cutting tool. When this occurs, the machine must be stopped and the obstructing tip material removed from the cutting tool. Interruptions in the stake pointing machine operation have a significant impact on machine productivity since it may take a minute or more for the cutting tool to stop rotating, an operator to access the cutting tool area to clear the obstructing material, and return the machine to operation.

It would be advantageous to have a means to clear broken portions of stakes from the cutting tool that does not require the cutting head rotation to be halted while a human operator manually clears the obstruction. Additional benefit could be derived if the means included provisions to improve the efficiency of chip and sawdust transport away from the cutting area and out of the cutting tool for collection by the facility dust collection system. Such an improvement would result in lower operating temperatures for the knives and extended sharpening intervals. Still further benefits would be realized if actuation of the clearing means is synchronized with the stake feed mechanism so that the stake pointing machine would automatically clear any obstructions in the cutting tool each time a stake is pointed.

SUMMARY OF THE INVENTION

Accordingly, the present invention, in any of the embodiments described herein, may provide one or more of the following advantages:

It is an object of the present invention to provide an improved cutting tool for a wooden stake pointing machine wherein the tool is configured to be self-clearing.

It is an object of the present invention to provide a self-cleaning cutting tool for a stake pointing machine that will dislodge obstructions from the cutting tool while the machine is operating.

It is an object of the present invention to provide a self-cleaning cutting tool for an automatic stake point machine that operates in conjunction with the material movement cycle for supplying unpointed wooden stakes to the cutting tool.

It is a further object of the present invention to provide a self-cleaning cutting tool for a stake pointing machine that removes obstructions in the cutting tool and discharges the obstructing material to a dust/debris collection system.

It is a further object of the present invention to provide a self-cleaning cutting tool for a stake point machine that is easily adaptable for use on a variety of stake pointing machine configurations.

It is a still further object of the present invention to provide an improved, self-cleaning cutting tool for a stake pointing machine that is durable in construction, inexpensive of manufacture, carefree of maintenance, easily assembled, and simple and effective to use.

These and other objects are achieved by an improved wooden stake pointing cutting tool that includes a movable plunger having motion coordinated with the feed and ejection motion of the stakes in the machine that assures that any debris entrapped in the cutting tool is dislodged and discharged from the cutting tool during the interval between the discharge of an already-pointed stake and the feeding of an un-pointed stake.

BRIEF DESCRIPTION OF THE DRAWINGS

The advantages of this invention will be apparent upon consideration of the following detailed disclosure of the invention, especially when taken in conjunction with the accompanying drawings wherein:

FIG. 3 is detail view of one embodiment of a cutting tool used on the machine embodying the present invention showing a plunger in the partially inserted position;

FIG. 4 is a detail view of cutting tool shown in FIG. 3 showing the plunger in a fully retracted position;

FIG. 5 is a section view taken along cut line 5-5 in FIG. 3;

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined when viewing the machine as it is normally positioned on a level operating surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
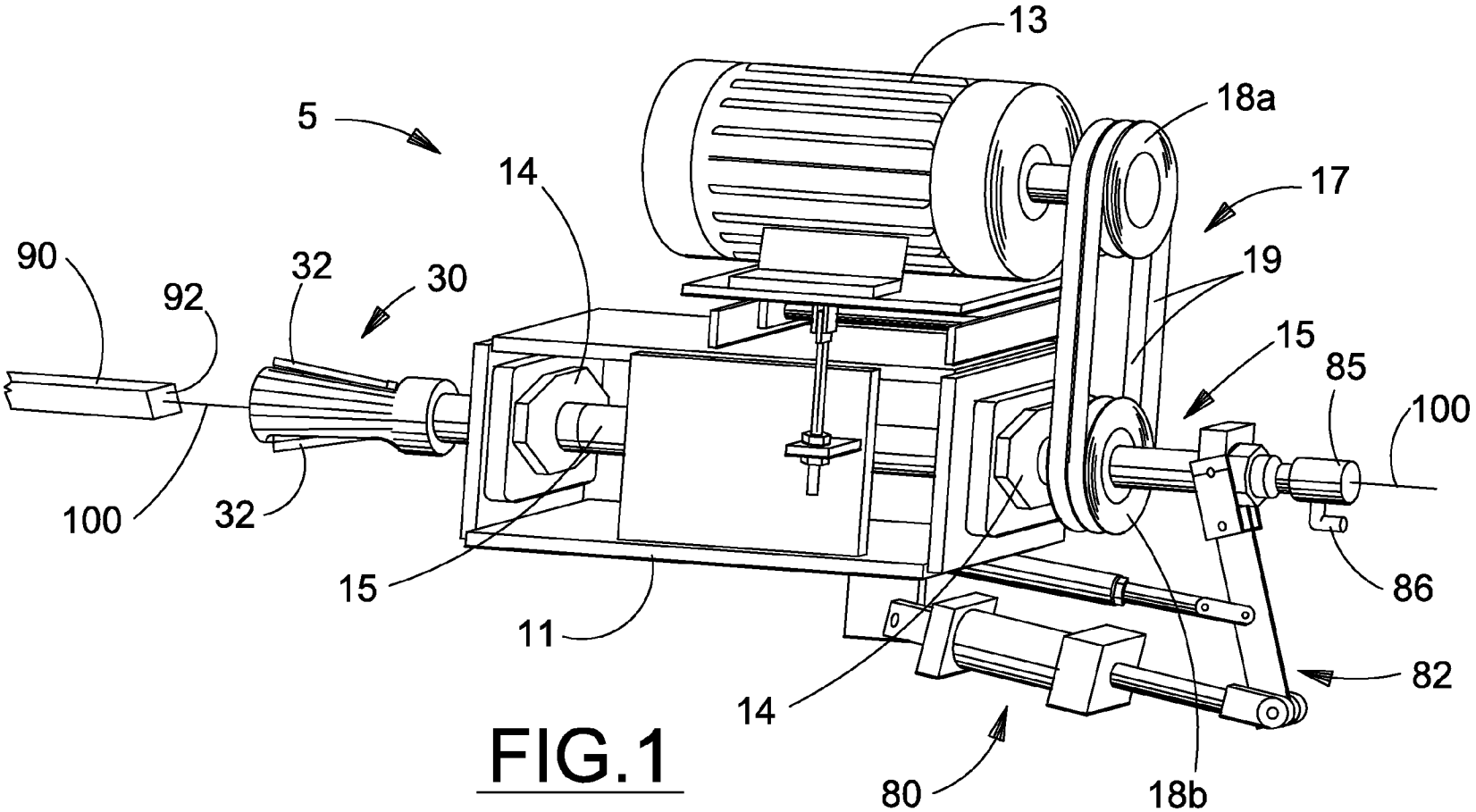
FIG. 1 is a partial side view of a milling portion of a stake pointing machine on which the present invention is useful.
Figure 2:
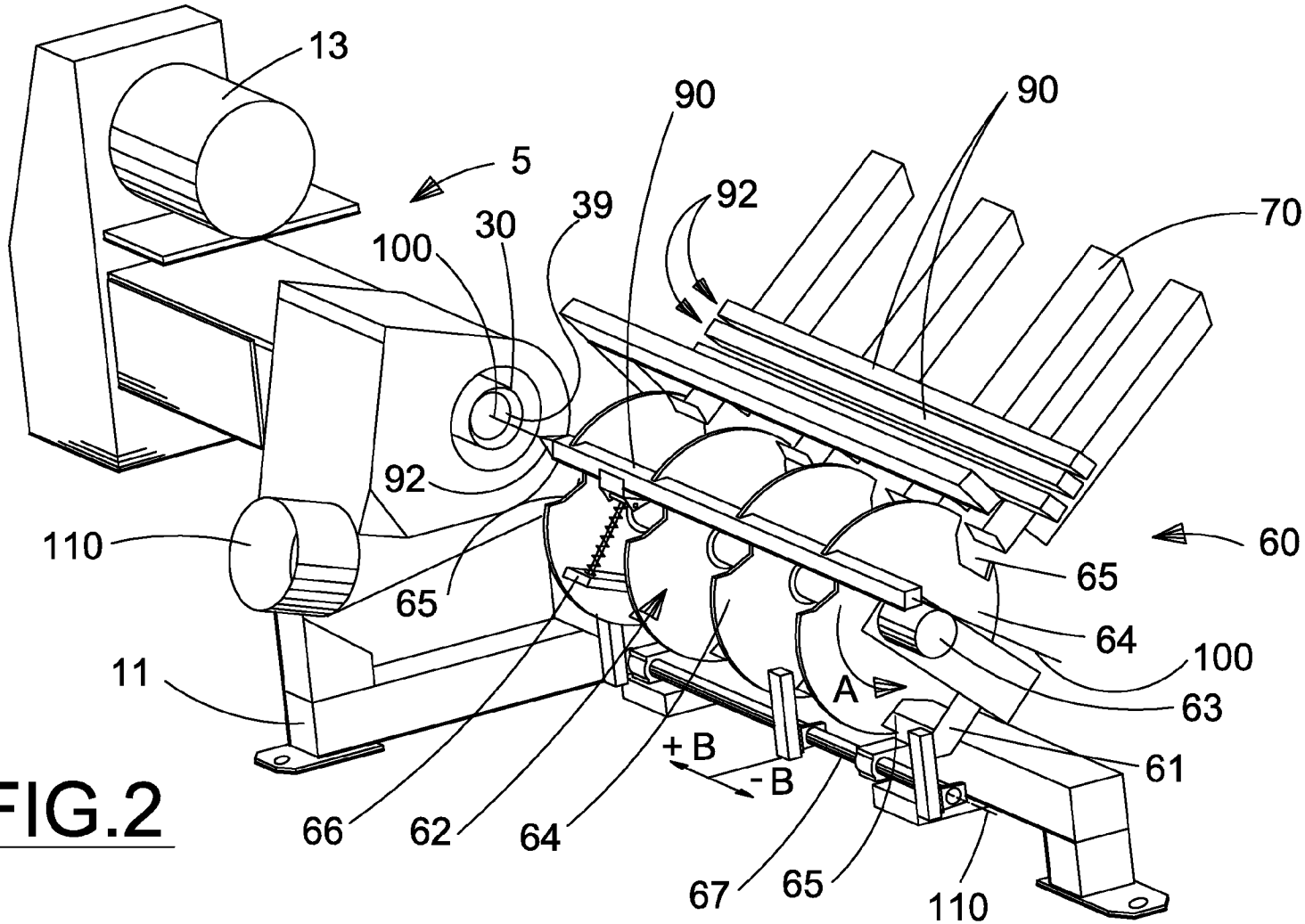
FIG. 2 is a partial perspective of the stake pointing machine embodying the present invention showing a work piece feeding mechanism which enables greater automation of the operation.
Figure 7:
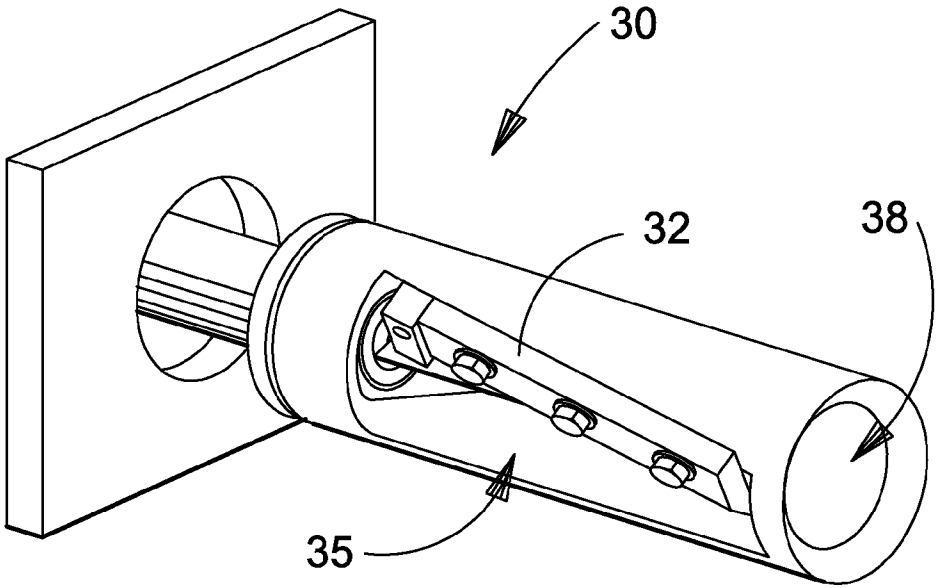
FIG. 7 is a partial perspective view of the cutting tool shown in FIG. 5 showing the orientation of the knives with respect to the rotational axis and the configuration of a debris discharge opening.
Figure 6:
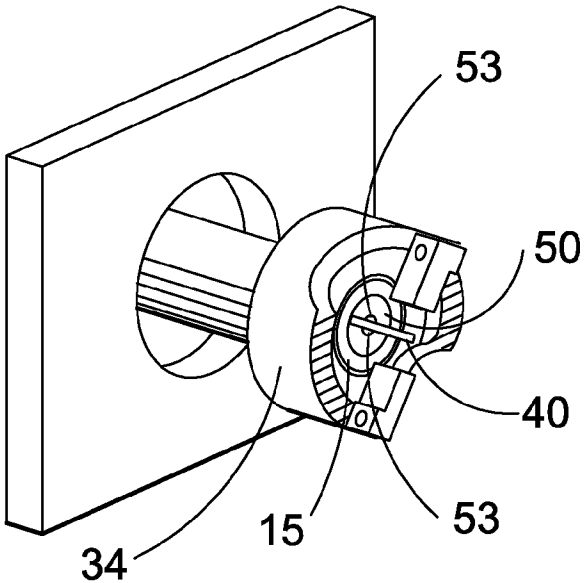
FIG. 6 is a partial perspective cut-away view of the cutting tool shown in FIGS. 3 and 4 showing the relationship of knives, a plunger, and an air supply port of the present invention.

First referring to FIGS. 1 and 2 wherein a stake pointing machine 5 incorporating one embodiment of the present invention is shown to comprise a base support 11, a driver 13 for rotating a drive shaft 15 through a drive mechanism 17, and a cutting tool 30 connected to the drive shaft 15 for rotation therewith. As shown in FIG. 1, drive mechanism 17 comprises a pair of pulleys 18*a*, 18*b* connected by at least one drive belt 19. Drive shaft 15 is conventionally supported by the base support frame 11 by one or more bearings 14. A feeding apparatus 60 for sequentially supplying elongate, unpointed wooden stakes (work piece 90), each work piece typically having a generally square or rectangular cross section area to the stake pointing machine and positioning the work piece 90 stakes adjacent to the cutting tool such that the length of the work piece 90 is aligned along the rotational axis 100 of the drive shaft 15. The feeding apparatus secures the work piece 90 to prevent rotational movement and then moves each work piece axially until a first end 92 of the work piece 90 engages the cutting tool 30. The feeding apparatus is discussed in greater detail hereinafter. Angled knives 32 secured in the cutting tool cut first end 92 of the stake to taper the cross-sectional area and form a point. Rotation of the cutting tool 30 with a work piece in the tool and held to prevent rotation allows the knives 32 within the cutting tool 30 to remove material from the end of the work piece and form a pointed end on the stake. Once the end of the work piece stake is pointed, the feeding apparatus retracts the work piece axially, discharges the pointed work piece, and feeds the next unpointed work piece into the cutting tool 30. Those skilled in the art will recognize that the same function may also be accomplished by restraining the wooden work pieces both axially and rotationally while moving the cutting tool axially to engage and point the end of the wooden work piece. Such variation in the relative movement of the stake and the cutting tool is contemplated within the scope of the present invention.

The feeding apparatus 60 is connected to base support 11 or otherwise anchored to prevent relative movement between the feeding apparatus and the cutting tool mounted on the point machine. A preferred embodiment of the feeding apparatus 60 comprises a movable chassis 61 which supports a rotating feed mechanism 62 comprising shaft 63 to which are connected a plurality of generally circular feed disks 64 configured for rotation with shaft 63, generally in the direction indicated as "A" in FIG. 2. Each disk 64 has at least one notch 65 for receiving a work piece. Work pieces 90 are held in a supply structure 70. Supply structure 70 provides a generally planar surface, or individual supports arranged to define a plane, that is aligned along an axis radial to rotating feed mechanism 62. The plane of supply structure 70 is upwardly angled with respect to feed structure 62 to allow gravity to urge the work pieces 90 toward the periphery of the rotating feed disks 64. As the feed structure 62 rotates, a work piece is engaged by the feed notch 65. Further rotation of feed structure 62 causes the work piece to be positioned on the rotational axis 100. A work piece clamp 66 engages the work piece to restrain it in position in the notch 65. Movement of clamp 66 is preferably interconnection with the rotation of feed structure 62, such as by a cam and follower arrangement, so that the clamping action occurs automatically and simultaneously with rotation of the feed structure. Once work piece 90 is aligned on rotational axis 100, chassis 61 is moved toward pointing machine 5, in the direction shown as +B, from an initial (feed) position so that the first end 92 of the work piece to be pointed is moved axially along rotational centerline 100 into the cutting zone 39. As the feed structures moves the first end of the work piece into the cutting zone, the rotating knives will begin removing material from the first end to form the tapered point. The rate of movement in the +B direction is determined by at least the rotational speed of the cutting tool 30 and material of the work piece. Once the taper is completed, as the chassis reaches the distalmost position in the +B direction (the pointing position), the direction of axial motion of the feed structure 62 is reversed to withdraw the pointed work piece 90 from the cutting tool 30. When the feed structure has been fully retracted and returned to the feed position, the feed structure is again rotated to discharge the work piece and load the next work piece from the supply structure.

Efficiency of the operation is improved by the inclusion of three notches symmetrically located about the periphery of each feed disk 64. By doing so, one work piece will be engaged by the notches from the supply structure, a second work piece will be aligned on the rotational axis for pointing, and a third work piece, having already been pointed, may be discharged from the apparatus. In this manner, the three steps of loading an unpointed work piece, aligning an unpointed work piece on the rotational axis, and discharging a pointed work piece can be performed simultaneously with a single rotational step of the feed structure 62.

Now referring to FIGS. 3 through 7 wherein detail views of one embodiment of the cutting tool 30 are shown. As shown, cutting tool 30 further comprises a holder 34 having a connection end 37 that is coupled to drive shaft 15 for rotation therewith. Holder 34 also includes an aperture end 38 which opens on the end opposite the connection end 37 and is configured to receive an end of a work piece which is to be pointed. Holder 34 includes a plurality of cutting knives 32 that are secured to holder 34 by conventional means, shown as bolts 52 in the depicted embodiment. Knives 32 are positioned in holder 34 such that the cutting edge axes 33 of the knives are convergently aligned so that a tapered end will be formed on a work piece. The axes converge at an apex 31 that is adjacent to the connection end 37 of the cutting tool 30. However, the cutting edge axes 33 of the knives are laterally displaced from the rotational axis 100 thereby creating a first gap, shown as G2 in FIG. 5, therebetween centered on the rotational axis. A second gap, shown as G1 in FIG. 5 may be created by truncating a portion of the knives apart from the apex position so that the tapered end of the work piece as it is cut does not terminate in a point, but is truncated. Thus, the cutting edges axes 33 appear to converge when viewed in one dimension, but the axes are non-parallel to form the taper, and non-converging to provide a gap between the knives.

A cutting region 39 is defined within the cutting tool by the cutting knives which are divergently angled with respect the rotational centerline 100, commencing at apex 31 and extending in the direction of aperture end 38. Aperture end 38 is generally circular and size to at least the diagonal maximum dimension of the largest anticipated work piece. In one embodiment, the diameter of aperture end is approximately three inches. At least one opening 35 is provided in the periphery of holder 34 adjacent to the knives 32 to allow material removed from the work piece to be discharged from the cutting region 39. The opening also provides access to removable connections for the cutting knives 32 thereby allowing knives to be periodically replaced or removed for sharpening. The opening 35 on the outer circumference of the tool also allows wood shavings, dust, and other debris generated by the cutting operation to be expelled from the cutting region 39. The contour of opening 35 is configured to direct air flow radially outwardly from the cutting region 39 to assist in expelling cutting debris from the cutting tool 30.

The stake pointing machine 5 is also provided with a movable plunger 40 that is disposed within drive shaft 15 and rotates therewith. The tip portion of the plunger that extends into the cutting zone has a flat, plate-like configuration which permits the plunger 40 to extend into the cutting region 39 through the gap between the knives without impacting the edges of the cutting knives 32. In the preferred embodiment, plunger 40 is fabricated from an elongate strip of metal plate having a width that is approximately one-half to three-quarters of the maximum cutting diameter of the cutting head 30 aperture end 38, and a thickness sufficient to maintain rigidity of the plunger 40 yet still fit between the cutting knives 32 in the area adjacent to the apex 31. The plunger length is ideally approximately equal to the axial length of the cutting region within the cutting head, but slightly shorter lengths may also provide acceptable results. Plunger 40 is selectively movable between two positions. In the first position, the plunger 40 is disposed substantially within the drive shaft 15 so that it does not protrude into the cutting region as shown in FIG. 2. In the second position, the plunger 40 is extended from within the drive shaft into the cutting region 39. Plunger 40 is shown in an intermediate position in FIG. 3 as it is being inserted toward the second position. During movement from the first position to the second position, the plunger 40 will contact any obstructions that may be lodged adjacent to the apex 31 in the cutting tool 30 and force such obstructing debris out of the cutting tool. The plunger 40 may be selectively moved axially while the drive shaft 15 rotates to allow operation without shutting down the point machine.

Plunger 40 is connected to and moved by a plunger shaft 50. Plunger shaft 50 is concentrically disposed within the hollow drive shaft 15 so that it rotates in conjunction with the drive shaft 15, but may be moved axially relative to the drive shaft. This synchronous rotation may be effected by a keyway, non-circular cross-sectional interface, or any other known method for rotationally connecting the concentric drive and plunger shafts. Plunger shaft 50 ideally extends through at least the length of drive shaft 15 to allow a convenient connection for an actuator 80 at the end opposite the cutting head. Movement of the plunger via the plunger shaft 50 may be by mechanical linkage, electro-magnetic, pneumatic, or hydraulic. In the embodiment shown in FIG. 1, the plunger shaft 50 is actuated by a pneumatic actuator 80 connected to the shaft by a mechanical linkage 82. Furthermore, there numerous functionally equivalent method for connecting the actuator 70 to the reciprocating and rotating plunger shaft 50 that are similarly contemplated within the scope of the present invention. The figures presented use one such means for illustration of the operating principle of the invention. Plunger 40 movement may be initiated manually, in response to an indicated obstruction, or synchronized with the feeding of stakes so that the plunger "clears" the cutting tool with each stake feed cycle so that the stake pointing operation is fully automatic.

The plunger is shown in FIG. 3 in the first, or retracted, position in this figure as it would be when a work piece is being pointed by the machine 5. Once the stake pointing operation is completed and the work piece is removed from the cutting tool, the plunger may be moved toward the second position, as illustrated in FIG. 4, and into the cutting region 39 to dislodge any remaining obstruction in the cutting tool 30. In the second position, the plunger tip extends approximately to the open aperture end 38. In the embodiment shown, the first and second positions are approximately 4½ inches apart. It should be noted that the distance separating the first and second positions is determined by the axial distance of the cutting region 39, measured from the apex 31 of the cutting knives to the opposite end of the knives 32. Thus, the distance the plunger is required to extend into the cutting region and the length of the plunger itself is determined by the size of the cutting tool.

The plunger shaft may be supported within the drive shaft by bearings, bushings, or other functionally equivalent means to permit axial motion of the plunger shaft in relation to the drive shaft without excessive frictional resistance while the plunger shaft and the drive shaft rotate in unison. In the embodiment shown, the plate-like tip of the plunger 40 is connected to a hollow tube which functions as the plunger shaft 50 and provides a passageway for compressed air used for clearing debris from the cutting tool, the latter function being discussed in additional detail hereinafter. It is to be noted that the embodiment of the plunger tip portion shown is optimized for use in a cutting tool having two generally symmetrically positioned cutting knives. The configuration of the tip portion of the plunger may be altered to fit into the space between the number of cutting blades present in the cutting tool. Cutting tools having one more knives are envisioned with two or three knives offering an effective balance between cutting edge and space for the plunger.

Further improvement in the stake pointing machine is achieved by providing pressurized air into the cutting region 39 during the pointing operation to expel debris. Pressurized air is introduced into a conduit 52 within the plunger shaft 50 and expelled into the cutting region thorough openings adjacent to the plunger at the intersection of the flat plate plunger to the generally cylindrical plunger shaft and conduit. The air flow into the cutting region causes debris that is loosened by movement of the plunger, but which may be partially impaled on the knives, to be forced out of the cutting region through openings 35 by the forced of the pressurized air. Air flow impinging on any debris present forces it to be expelled from the cutting tool where it is then gathered by the dust collection system, shown including a collection housing 110. An added benefit of the pressurized air flow through the cutting tool is to promote discharge of sawdust and other debris from the cutting operation from the cutting tool. The openings may also be specially contoured to promote radially outward airflow from the tool. The air flow contributes to the effectiveness of known dust collection systems used in wood milling and cutting operations. Furthermore, the orientation of the opening in the plunger shaft directs a portion of the air flow supplied to the cutting head axially toward the open end of the cutting tool.

Pressurized air may be supplied using a swivel connection fitting 85 on the plunger shaft which provides a relatively stationary pneumatic connection 86 to the rotating plunger shaft, the conduit 52 therein which also functions as the air supply conduit to the cutting tool.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A machine for shaping an end of an elongate wooden work piece to form a pointed tip on said work piece, said machine comprising:

a frame;

an elongate first shaft rotatably supported by said frame along a rotational axis, said first shaft having a first channel extending axially therethrough;

an elongate second shaft disposed in said first channel and configured for rotation with said first shaft, said second shaft further configured for axial movement relative to said first shaft, said second shaft having a first end and a second end;

a cutting head having a connection end and an aperture end opposingly displaced along said rotational axis, said connection end connected to said first shaft for rotation of said cutting head therewith, said cutting head further having a plurality of knives configured to form a pointed end on the work piece as said cutting head rotates, each of said plurality of knives having an edge angled relative to said rotational axis, said plurality of edges further configured non-parallel and non-intersecting with one another, rotation of said edges defining a cutting zone within said cutting head; and a plunger connected to said first end of said second shaft, said plunger selectively movable between opposing first and second positions, said plunger being substantially disposed within said first channel when in said first position, said plunger extending substantially into said cutting zone when in said second position, whereby movement of said plunger from said first position toward said second position dislodges any portion of the work piece that remains in the cutting zone thereby enabling said cutting head to accept a subsequent work piece.

2. The machine as described in claim 1, wherein said plurality of edges are laterally displaced from said rotational axis creating a gap therebetween, said gap being symmetrically aligned on said rotational axis.

3. The machine as described in claim 2, wherein said plunger is configured to fit within said gap when moved along said rotational axis.

4. The machine as described in claim 3, wherein said plurality of edges are angled relative to said rotational axis simultaneously in two perpendicular planes.

5. The machine as described in claim 3, wherein said second shaft further comprises an interior conduit extending axially therethrough, said conduit terminating at said first end adjacent to said plunger, said conduit sealed at said second end and having a connection adjacent to said second end for introducing a flow of pressurized air into said interior conduit whereupon said air flow is directed through said interior conduit and discharged adjacent to said plunger.

6. The machine as described in claim 5, further comprising an actuator and a linkage, said linkage configured to connect said actuator to said second shaft in a manner enabling selective movement of said second shaft between said first and second positions by said actuator.

7. The machine as described in claim 6, further comprising a feeding mechanism for sequentially positioning one of a plurality of said work pieces along said rotational axis, said feeding mechanism configured to move said work piece axially in an insertion direction along said rotational axis to momentarily position an end of each work piece in said cutting zone and move said work piece axially in a direction opposite said insertion direction to withdraw said end of said work piece from said cutting zone.

8. A method for milling a point on a wooden work piece comprising the steps:

providing a frame-mounted rotating hollow elongate drive shaft;

providing a plunger shaft positioned within the drive shaft configured to rotate therewith and allow axial movement relative thereto;

providing a cutting head connected to one end of the drive shaft for rotation therewith;

providing a plurality of knives in the cutting head configured to form a pointed end on the work piece as the cutting head rotates, the knives further configured in a non-parallel and non-intersecting arrangement relative to one another, rotation of the knives defining a cutting zone within the cutting head;

providing a plunger connected to one end of the plunger shaft, the plunger being selectively movable between a first position wherein the plunger is substantially disposed within the drive shaft, and a second position wherein the plunger extends substantially into the cutting zone;

providing a feeding mechanism for sequentially receiving one of a plurality of wooden work pieces from a supply holder, positioning each wooden work piece along the rotational axis, moving the work piece axially along the rotational axis to momentarily position an end of the work piece in the cutting zone, and discharging each work piece to a finished work piece collector;

providing a driver for rotating the drive shaft;

providing an actuator for selectively moving the plunger between the first and second positions;

providing a controller for sequencing movement of the feeding mechanism and operating the plunger actuator;

supplying a plurality of elongate wood workpieces to the supply holder;

operating the driver to rotate the drive shaft;

receiving, by the feeding mechanism, a first work piece from the supply holder;

positioning, by the feeding mechanism, of the first work piece in a feed position on the rotational axis;

axially moving in a first direction, by the feeding mechanism, of the first work piece to a cutting position wherein one end of the work piece is in the cutting zone;

maintaining one end of the work piece in the cutting zone wherein it interacts with the rotating knives for a sufficient time for the rotating knives to taper the end of the work piece;

axially moving in a reverse, by the feeding mechanism, of the first work piece from the cutting position to the feed position;

moving, by the plunger actuator, of the plunger from the first position to the second position and the returning the plunger to the first position;

discharging the first work piece from the feeding mechanism; and receiving, by the feeding mechanism, a second work piece from the supply holder.

9. The method as described in claim 8, further comprising the steps of:

providing a feeding mechanism configured to engage three work pieces simultaneously;

receiving, by the feeding mechanism, a first work piece from the supply holder;

positioning, by the feeding mechanism, a second work piece in a feed position on the rotational axis; and discharging a third work piece from the feeding mechanism, wherein the steps of receiving, positioning, and discharging are simultaneously performed.

10. The method as described in claim 9, further comprising the steps of:

providing an interior conduit extending axially through the plunger shaft;

providing an opening from the conduit adjacent to the plunger;

providing a coupling for selectively introducing compressed air into the conduit; and supplying compressed air to the coupling whereby a flow of air may be directed through the conduit and through the opening whereupon it is discharged from the cutting head.

* * * * *